US006624799B1

(12) United States Patent
Kang et al.

(10) Patent No.: US 6,624,799 B1
(45) Date of Patent: Sep. 23, 2003

(54) RADIO FREQUENCY PLASMA DISPLAY PANEL

(75) Inventors: Jung Won Kang, Seoul (KR); Eun Ho Yoo, Koyang-shi (KR); Myung Ho Park, Seoul (KR)

(73) Assignee: LG Electronics Inc., Seoul (KR)

( * ) Notice: Subject to any disclaimer, the term of this patent is extended or adjusted under 35 U.S.C. 154(b) by 170 days.

(21) Appl. No.: 09/714,429

(22) Filed: Nov. 17, 2000

(30) Foreign Application Priority Data

Nov. 18, 1999 (KR) ..... 1999-51211
Nov. 18, 1999 (KR) ..... 1999-51213

(51) Int. Cl.[7] ..... G09G 3/28; G09G 3/20
(52) U.S. Cl. ..... 345/67; 345/60; 345/55
(58) Field of Search ..... 345/55–72; 313/581–587; 315/169.1, 169.4

(56) References Cited

U.S. PATENT DOCUMENTS 5,684,361 A * 11/1997 Seki ..... 313/582
5,772,486 A * 6/1998 Seki ..... 445/24
5,952,782 A * 9/1999 Nanto et al. ..... 313/584
6,097,149 A * 8/2000 Miyaji et al. ..... 313/582
6,262,532 B1 * 7/2001 Park et al. ..... 315/169.4
6,265,826 B1 * 7/2001 Miyazaki ..... 313/586
6,271,810 B1 * 8/2001 Yoo et al. ..... 345/60
6,291,943 B1 * 9/2001 Murai et al. ..... 315/169.3

FOREIGN PATENT DOCUMENTS

| | | |
|---|---|---|
| JP | 4-75232 | 3/1992 |
| JP | 4-277442 | 10/1992 |
| JP | 6-267430 | 9/1994 |
| JP | 6-310040 | 11/1994 |
| JP | 10-308176 | 11/1998 |
| JP | 10-308178 | 11/1998 |

* cited by examiner

*Primary Examiner*—Steven Saras
*Assistant Examiner*—Michael J. Moyer
(74) *Attorney, Agent, or Firm*—Fleshner & Kim, LLP

(57) ABSTRACT

A radio frequency plasma display panel that is capable of reducing a height of a barrier rib and a frequency of a radio frequency signal as well as improving a light-emission efficiency. In the radio frequency plasma display panel, a plurality of discharge cells are arranged in a matrix pattern. Each of the discharge cells has upper and lower substrates. First and second address electrodes are provided on at least one of the upper and lower substrates to generate an address discharge. Barrier ribs are provided between the upper and lower substrates to define a discharge space. First and second radio frequency electrodes are provided the respective barrier ribs opposed to each other to generate a radio frequency sustaining discharge. Accordingly, the radio frequency sustaining discharge is generated between the first and second radio frequency electrodes within the respective barrier ribs for a long time, so that a height of the barrier ribs and a frequency of a radio frequency signal can be lowered.

13 Claims, 11 Drawing Sheets

RADIO FREQUENCY PLASMA DISPLAY PANEL

BACKGROUND OF THE INVENTION

1. Field of the Invention

This invention relates to a radio frequency plasma display panel, and more particularly to a radio frequency plasma display panel that is capable of reducing a height of a barrier rib and a frequency of a radio frequency signal as well as improving a light-emission efficiency.

2. Description of the Related Art

Recently, a plasma display panel (PDP) feasible to the fabrication of large-scale panel has been available for a flat panel display device. The PDP takes advantages of a fact that an ultraviolet ray generated by a gas discharge radiates a fluorescent material to generate a visible light, thereby displaying a picture. There has been actively made a study as to a radio frequency PDP that is capable of dramatically improving a discharge efficiency and a brightness in comparison to the conventional alternating current (AC) surface discharge PDP. In the radio frequency PDP, electrons making an oscillating motion within a discharge space continuously ionize a discharge gas by a radio frequency of hundreds of MHz to make a continuous discharge for most discharge time. Such a radio frequency discharge has the same physical characteristic as a positive column at a glow discharge structure.

FIG. 1 is a section view showing the structure of a discharge cell in a conventional radio frequency PDP employing the above-mentioned radio frequency discharge. In FIG. 1, the discharge cell includes a radio frequency electrode 12 provided on an upper substrate 10, a data electrode 18 and a scanning electrode 22 provided on a lower substrate 16 in such a manner to be perpendicular to each other, and barrier ribs 28 provided between the upper substrate 10 and the lower substrate 16. The radio frequency electrode 12 applies a radio frequency signal. A first dielectric layer 14 is formed on the upper substrate 10 provided with the radio frequency electrodes 12. The data electrode 18 applies a data signal for causing an address discharge to select cells to be displayed. The scanning electrode 22 applies a scanning signal for said address discharge. Also, the scanning electrode 22 is opposed to the radio frequency electrode 12 in such a manner to be used as a counterpart electrode of the radio frequency electrode 12. Between the data electrodes 18 and the scanning electrodes 22 is provided a second dielectric layer 20 for charge accumulation and isolation. On the second dielectric layer 20 provided with the scanning electrodes 22, a third dielectric layer 24 for charge accumulation and a protective film 26 are sequentially disposed. The barrier ribs 28 shut off an optical interference between the cells. In this case, since a distance between the radio frequency electrode 12 and the scanning electrode 22 is sufficiently assured for the sake of a smooth radio frequency discharge, the barrier ribs 24 are provided at a higher level than those in the existent AC surface-discharge PDP. Alternately, the barrier ribs 28 may be formed into a lattice structure closed on every side for each discharge cell so as to isolate the discharge space. This is because it is difficult to isolate plasma for each cell unlike the existent surface discharge due to the opposite discharge generated between the radio frequency electrodes 12 and the scanning electrodes 22. A fluorescent material 30 is coated on the surface of the barrier rib 28 to emit a visible light with an inherent color by a vacuum ultraviolet ray generated during the radio frequency discharge. The discharge space defined by the upper substrate 10, the lower substrate 16 and the barrier ribs 28 is filled with a discharge gas.

The radio frequency PDP having the configuration as described above is driven with a drive waveform as shown in FIG. 2. A radio frequency signal RFS is continuously applied to the radio frequency electrode 12. When charged particles exist in the discharge space 32, a discharge is not generated even though the radio frequency signal RFS is applied to the radio frequency electrode 12. A data signal DS is applied to the data electrode 18 in an address interval AP and a scanning signal SS is applied to the scanning electrode 22, thereby generating an address discharge. Electrons having a relatively high mobility in the charged particles make an oscillation motion between the radio frequency electrode 12 and the scanning electrode 22 during a discharge-sustaining interval SP by virtue of the radio frequency signal RFS. The oscillating electrons excite a discharge gas to generate a vacuum ultraviolet ray, which radiates the fluorescent material 30 to generate a visible light. After such a radio frequency discharge was sustained in the discharge-sustaining interval SP, it is interrupted by an erasing signal ES applied to any one of the data electrode 18 and the scanning electrode 22 in an erasure interval EP. In other words, the oscillating electrons are drawn into an electrode coupled with the erasing signal ES to be extinct, thereby stopping the radio frequency discharge.

The conventional radio frequency PDP driven in accordance with such a discharge mechanism has several problems in view of it structure.

First, in order to sustain the radio frequency discharge smoothly, a distance between the radio frequency electrode 12 and the scanning electrode 22, that is, a height of the barrier rib must be sufficiently assured. This is because an oscillation width of the electrons making an oscillation motion within the discharge space 32 depends on a frequency of the radio frequency signal RFS. More specifically, as a frequency of the radio frequency signal RFS goes lower, an oscillation width of the electrons is more and more increased. For this reason, when a frequency of the radio frequency signal RFS is not sufficiently high or when a distance between the radio frequency electrode 12 and the scanning electrode 22 is not sufficiently assured, the electrons within the discharge space 32 collide with the upper and lower substrates to be extinct, thereby no longer sustaining a discharge. Accordingly, in order to improve discharge efficiency, it is necessary to raise a frequency of the radio frequency signal RFS or to sufficiently assure a distance between two electrodes 12 and 22 used for the radio frequency discharge. For instance, when a frequency of the radio frequency signal RFS is 200 MHz, an optimal discharge efficiency can not be obtain until a distance between the radio frequency electrode 12 and the scanning electrode 22 becomes about 2 mm. Herein, to raise a frequency of the radio frequency signal RFS requires a driving circuit and a driving method that is capable of treating a high frequency of radio frequency signal RFS. It is difficult to apply this scheme in view of the current technical state and the cost. Accordingly, it is necessary to sufficiently assure a distance between the radio frequency electrode 12 and the scanning electrode 22 so as to obtain desired discharge efficiency with lowering a frequency of the radio frequency signal RFS. However, since a scheme of assuring a distance between the radio frequency electrode 12 and the scanning electrode 20 is determined depending on a height of the barrier rib 28 shown in FIG. 1, it has a burden in that the barrier rib 28 must be provided to have a large height. This is because it is difficult to implement a barrier rib having a large height of more than 0.5 mm by the conventional barrier rib fabricating methods such as the screen printing method and the sand blast method, etc. Also, when a height of the barrier rib 28 is more than 1 mm, it is difficult to uniformly coating the fluorescent material 30 on the inner surface of the barrier rib 28 and a transmissivity of a visible light generated from the fluorescent material 30 is reduced.

Second, the conventional radio frequency PDP has a problem in that, since the scanning electrode 22 is commonly used for an address discharge and a radio frequency sustaining discharge, a driving method is complicated and an electrical interference between the two discharges occurs. Particularly, the radio frequency signal RFS applied to the discharge cell makes an affect to an alternating current voltage source applying the scanning signal SS via the scanning electrode 22, and therefore the address discharge is influenced by the radio frequency signal RFS. A low pass filter has been used among the scanning electrode 11, the data electrode 18 and the alternating current voltage source so as to prevent such an influence of the radio frequency signal RFS. However, this more complicates the driving circuit.

Third, a thickness of the second and third dielectric layers 20 and 24 on the data electrode 18 used for an address discharge is very large. Since a data voltage applied from the data electrode 18 to the discharge space drops due to the thick second and third dielectric layers 20 and 24, an address driving voltage must be raised. If the second dielectric layer 20 is set to a small thickness so as to reduce a voltage drop value cause by the thick second and third dielectric layers 20 and 24, then a parasitic capacitance between the data electrode 18 and the scanning electrode 22 rises to increase a leakage current. Therefore, it is difficult for the conventional radio frequency PDP to control a thickness of the second and third dielectric layers 20 and 24 so as to optimize an address discharge characteristic.

SUMMARY OF THE INVENTION

Accordingly, it is an object of the present invention to provide a radio frequency plasma display panel that is capable of reducing a height of a barrier rib and a frequency of a radio frequency signal as well as improving a sustaining-discharge efficiency.

A further object of the present invention is to provide a radio frequency plasma display panel that is capable of minimizing a mutual interference between an address discharge and a radio frequency sustaining discharge.

A yet further object of the present invention is to provide a radio frequency plasma display panel that can obtain an optimized address discharge characteristic.

In order to achieve these and other objects of the invention, a radio frequency plasma display panel according to the present invention having a plurality of discharge cells arranged in a matrix type, each of which includes first and second substrates; first and second address electrodes provided on at least one of the first and second substrates to generate an address discharge; barrier ribs provided between the first and second substrates to define a discharge space; and first and second radio frequency electrodes provided the respective barrier ribs opposed to each other to generate a radio frequency sustaining discharge.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 3:
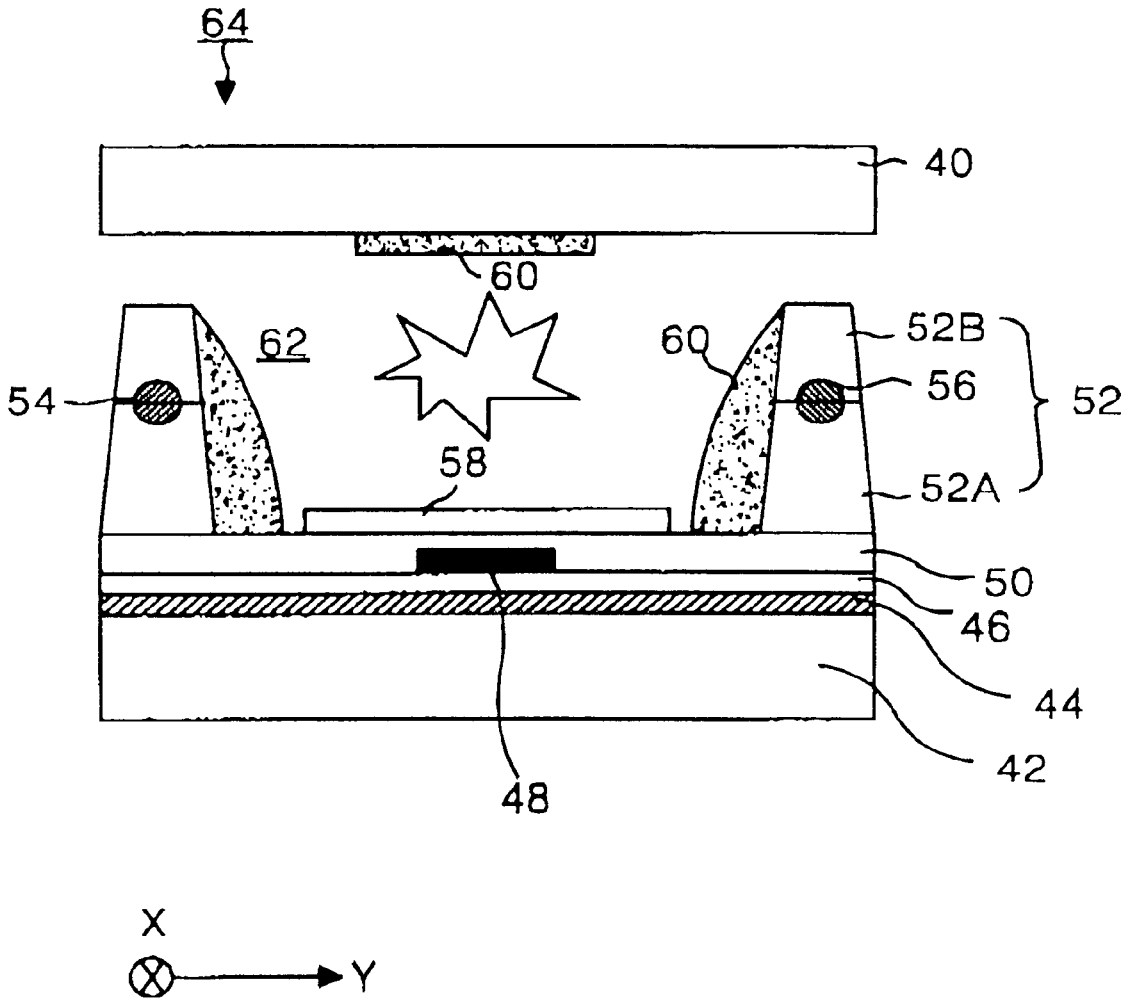
FIG. 3 is a section view showing a structure of a discharge cell in a radio frequency plasma display panel according to a first embodiment of the present invention.
Figure 4:
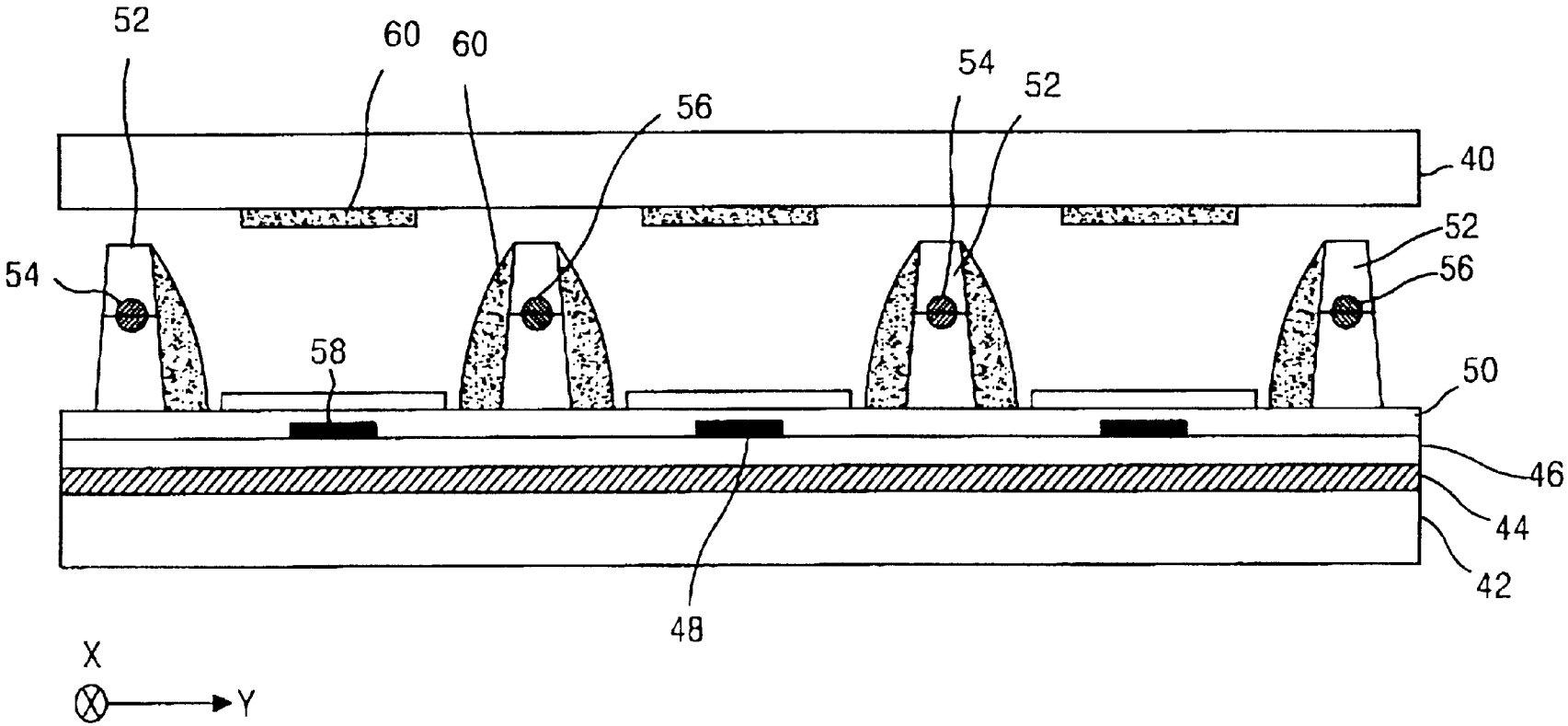
FIG. 4 is a section view of a plasma display panel in which the discharge cells shown in FIG. 3 are arranged in a matrix type.
Figure 5:
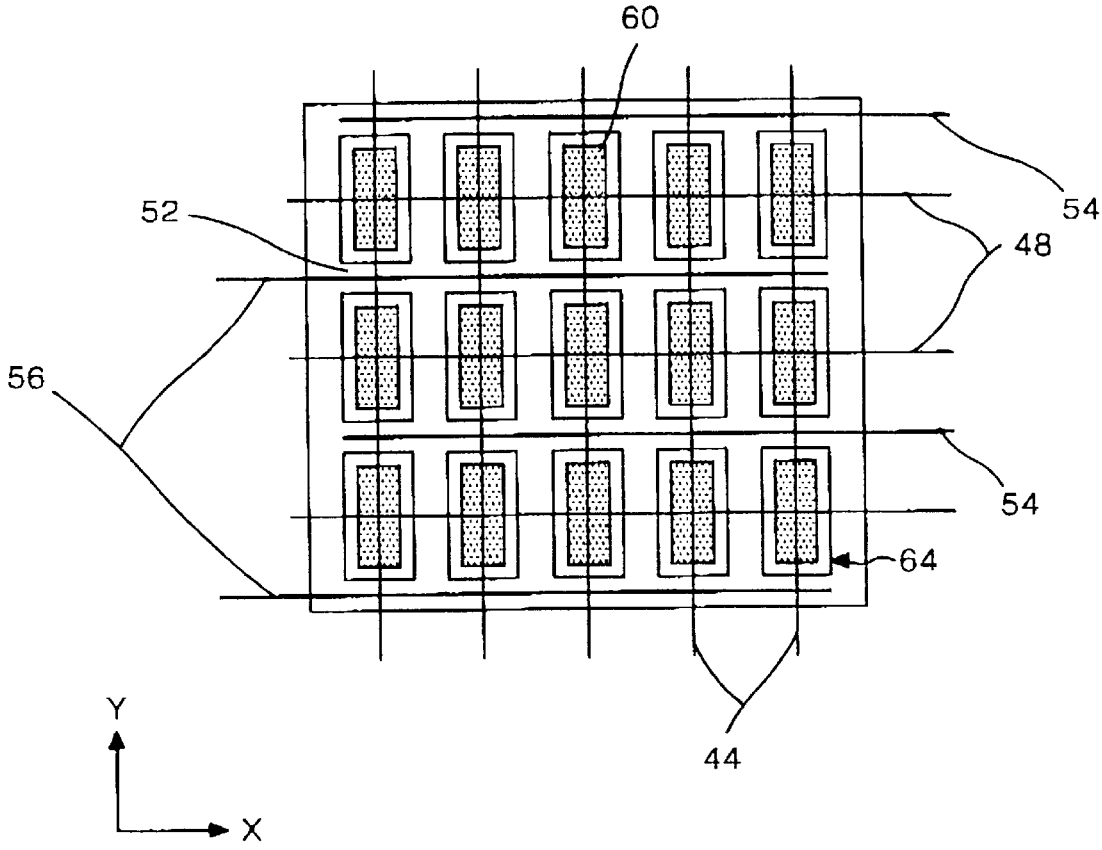
FIG. 5 is a plan view of a plasma display panel in which the discharge cells shown in FIG. 3 are arranged in a matrix type.

Referring to FIG. 3 to FIG. 5, a discharge cell 64 includes a data electrode 44 and a scanning electrode 48 provided perpendicularly on a lower substrate 42, lattice-shaped barrier ribs 52 provided between upper and lower substrates 40 and 42, a radio frequency electrode 54 and a radio frequency bias electrode 56 provided within the barrier ribs 52 in such a manner to be opposed to each other in a longitudinal direction Y of the discharge cell 64, and a discharge space 62 defined by the upper and lower substrates 40 and 42 and the barrier ribs 52 to be filled with a discharge gas. Such a discharge cell 64 is provided at each intersection between the data electrodes 44 and the scanning electrodes 48. The data electrode 44 applies a data signal for an address discharge. The scanning electrode 48 applies a scanning signal for an address discharge. A first dielectric layer 46 for insulation is provided between the data electrode 44 and the scanning electrode 48. A second dielectric layer 50 for insulation to plasma and electric charge accumulation is formed on the first dielectric layer 46 provided with the scanning electrode 48. On the second dielectric layer 50, the barrier ribs 56 for dividing each discharge cell and preventing electrical and optical interference between the adjacent discharge cells are formed in a lattice shape. The radio frequency electrode 54 and the radio frequency bias electrode 56 are provided within the barrier ribs 56 opposed to each other in the longitudinal direction Y of the discharge cell 64. The radio frequency electrode 54 applies a radio frequency signal and the radio frequency bias electrode 56 applies a bias voltage as a reference of the radio frequency signal, thereby generating a radio frequency sustaining discharge. The radio frequency electrode 54 and the radio frequency bias electrode 56 are shared in two adjacent discharge cells as shown in FIG. 4. Also, the radio frequency electrode 54 and the radio frequency bias electrode 56 are alternately arranged as shown in FIG. 5. A fluorescent material 60 is coated on the surfaces of the barrier ribs 56 and the upper substrate 40 exposed to the discharge space 62 to be radiated by virtue of an ultraviolet ray generated by a gas discharge, thereby generating a visible light. A coated area of the fluorescent material 60 is enlarged in comparison to the conventional radio frequency PDP, so that a light-emission efficiency can be improved. Herein, the fluorescent material 60 on the upper substrate 40 employs a light transmissive type that is not interfered with a transmitted visible light. On the second dielectric layer 50 exposed to the discharge space 62, a protective film 58 for providing the second dielectric layer 50 from the sputtering upon discharge and improving secondary electron generation efficiency is further provided.

In such a discharge cell 64, as the radio frequency electrode 54 and the radio frequency bias electrode 56 are formed at the interior of the barrier ribs 52, a distance between the two electrodes 54 and 56 is determined in accordance with a size of the discharge cell 64. Particularly, the radio frequency electrode 54 and the radio frequency bias electrode 56 are provided within the barrier ribs 52 parallel to each other in a longitudinal direction Y of the discharge cell 64 as shown in FIG. 5 so as to keep a distance as large as possible from each other. For instance, in the case of a VGA-level PDP, a length in the longitudinal direction Y and a width in the wide (or short axial) direction of the discharge cell 64 are set to about 1.2 mm and 0.4 mm, respectively. In this case, since a distance between the radio frequency electrode 54 and the radio frequency bias electrode 56 is about 1 mm, a frequency of the radio frequency signal is set to a relatively low value of about 40 MHz. On the other hand, in the case of an XGA-level PDP, a size of the discharge cell 64 is set to a half the size of the VGA-level PDP. In this case, since a distance between the radio frequency electrode 54 and the radio frequency bias electrode 56 is reduced to a half value in comparison to the VGA-level PDP, it is desirable that a frequency of the radio frequency signal is set to about 80 MHz. As described above, in the present radio frequency PDP, since a distance between the radio frequency electrode 54 and the radio frequency bias electrode 56 is irrespective of a height of the barrier rib 52, the barrier rib 52 is set to have a low height so that it can be easily formed by a conventional barrier rib fabricating method. Usually, it is desirable that a height of the barrier rib 52 suitable for the PDP is set to a relatively low value of 0.4 mm or a half thereof (0.2 mm) to be similar to a width of the discharge cell 64. By virtue of such a low-height barrier ribs 52, the fluorescent material 60 can be uniformly coated on the inner surfaces of the barrier ribs 52 unlike the conventional radio frequency PDP and a transmissivity of a visible light can be improved. A method of forming the radio frequency electrode 54 and the radio frequency bias electrode 56 at a middle height of the barrier ribs 52 is as follows:

First, the first barrier rib layers 52A are formed at almost middle value of the final barrier rib height by a conventional barrier rib fabricating method such as the screen printing method or the sand blast method, etc. Next, the radio frequency electrode 54 and the radio frequency bias electrode 56 are formed on the first barrier rib layers 52A opposed to each other in a longitudinal direction of the discharge cell 64. The electrode formation method can includes the sputtering method and the screen printing method, etc. The second barrier rib layers 52B are formed on the first barrier ribs 52A provided with the radio frequency electrode 54 and the radio frequency bias electrode 56 to complete the barrier ribs 52 having a final height.

Figure 2:
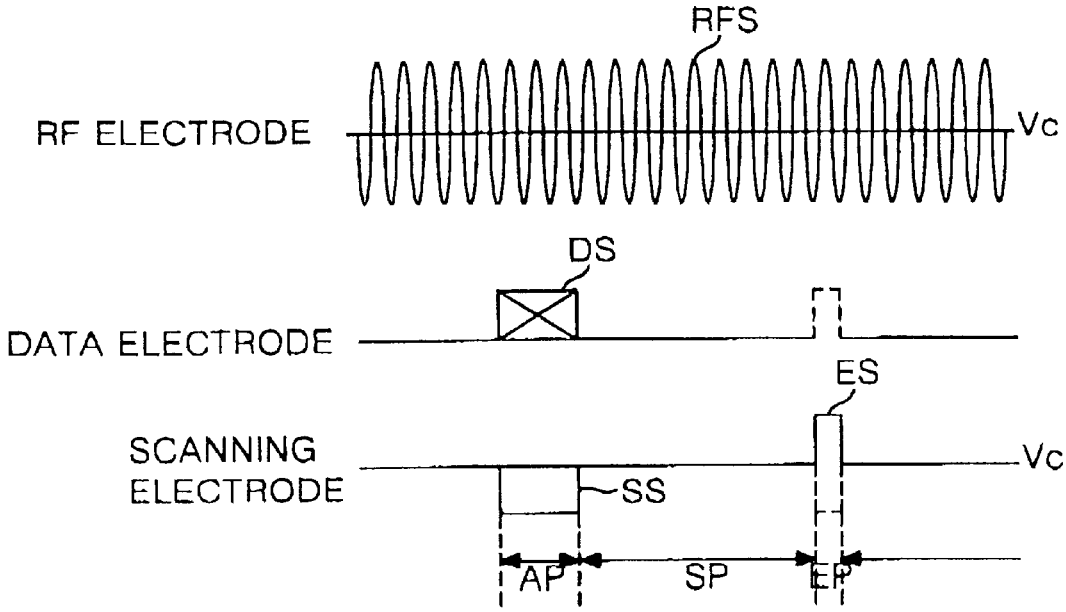
FIG. 2 RELATED ART
FIG. 2 is waveform diagrams of driving signals for driving the discharge cell shown in FIG. 1.

A method of driving such a discharge cell 64 in the radio frequency PDP is as follows:

First, a radio frequency signal RFS as shown in FIG. 2 is applied to the radio frequency electrode 54. A bias voltage of the radio frequency signal RFS is applied to the radio frequency bias electrode 56. A data signal DS and a scanning signal SS as shown in FIG. 2 are applied to the data electrode 44 and the scanning electrode 48, respectively. An address discharge is generated by the data signal DS and the scanning signal SS. Electrons having a relatively high mobility in charged particles produced by the address discharge make an oscillating motion between the radio frequency electrode 54 and the radio frequency bias electrode 56 in accordance with the radio frequency signal RFS to generate a sustaining discharge. The oscillating electrons continuously excite a discharge gas to generate a vacuum ultraviolet ray, which radiates the fluorescent material 60 to generate a visible light. By virtue of the electrodes oscillating in the longitudinal direction Y of the discharge cell 64 during the radio frequency sustaining discharge, plasma also is formed in the longitudinal direction of the discharge cell 64. Thus, a vacuum ultraviolet ray generated from the discharge gas effectively arrives at the fluorescent material 60 coated on the barrier rib 52 to improve a light-emission efficiency. The electrons are terminated by an erasing signal ES applied to any one of the data electrode 44 and the scanning electrode 48 as shown in FIG. 2 to interrupt the radio frequency sustaining discharge. As described above, the radio frequency PDP according to the first embodiment of the present invention has a four-electrode structure in which an address discharge is generated between the data electrode 44 and the scanning electrode 58 while a radio frequency sustaining discharge is generated between the radio frequency electrode 54 and the radio frequency bias electrode 56. Accordingly, the address discharge and the radio frequency sustaining discharge are generated by a different electrode, so that an electrical interference between the two discharges can be minimized.

Figure 6:
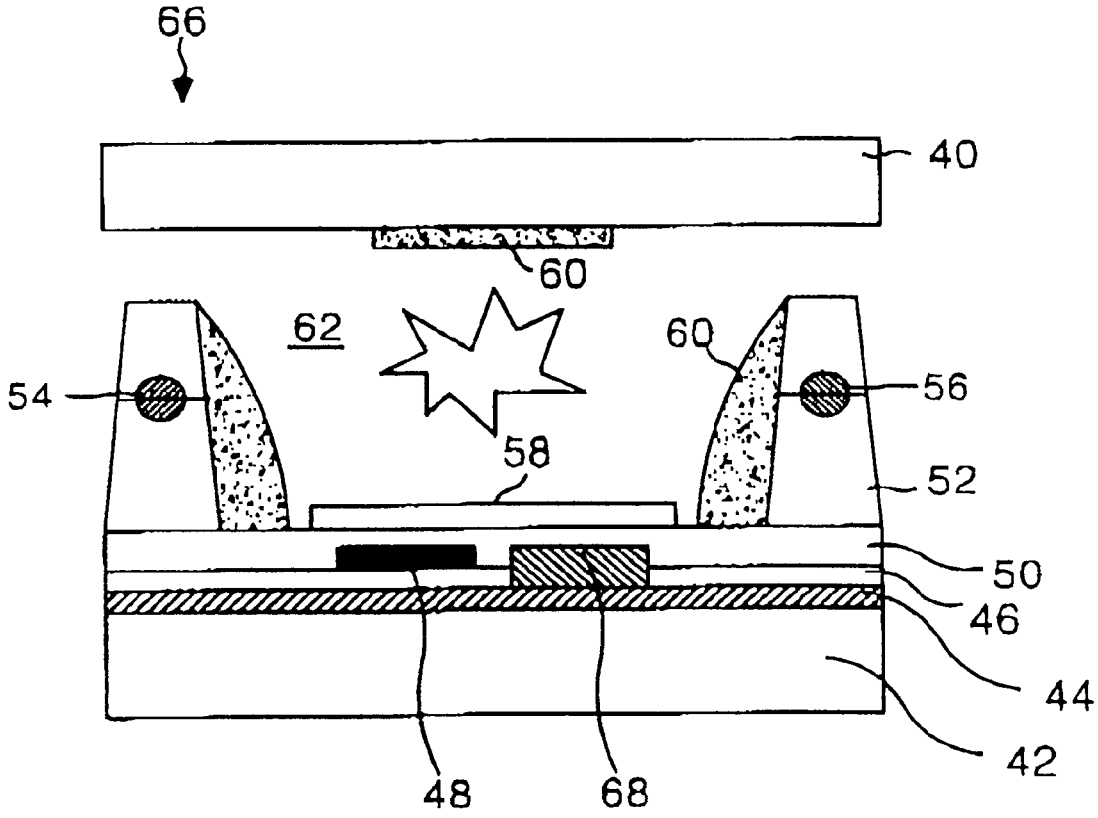
FIG. 6 is a section view showing a structure of a discharge cell in a radio frequency plasma display panel according to a second embodiment of the present invention.
Figure 7:
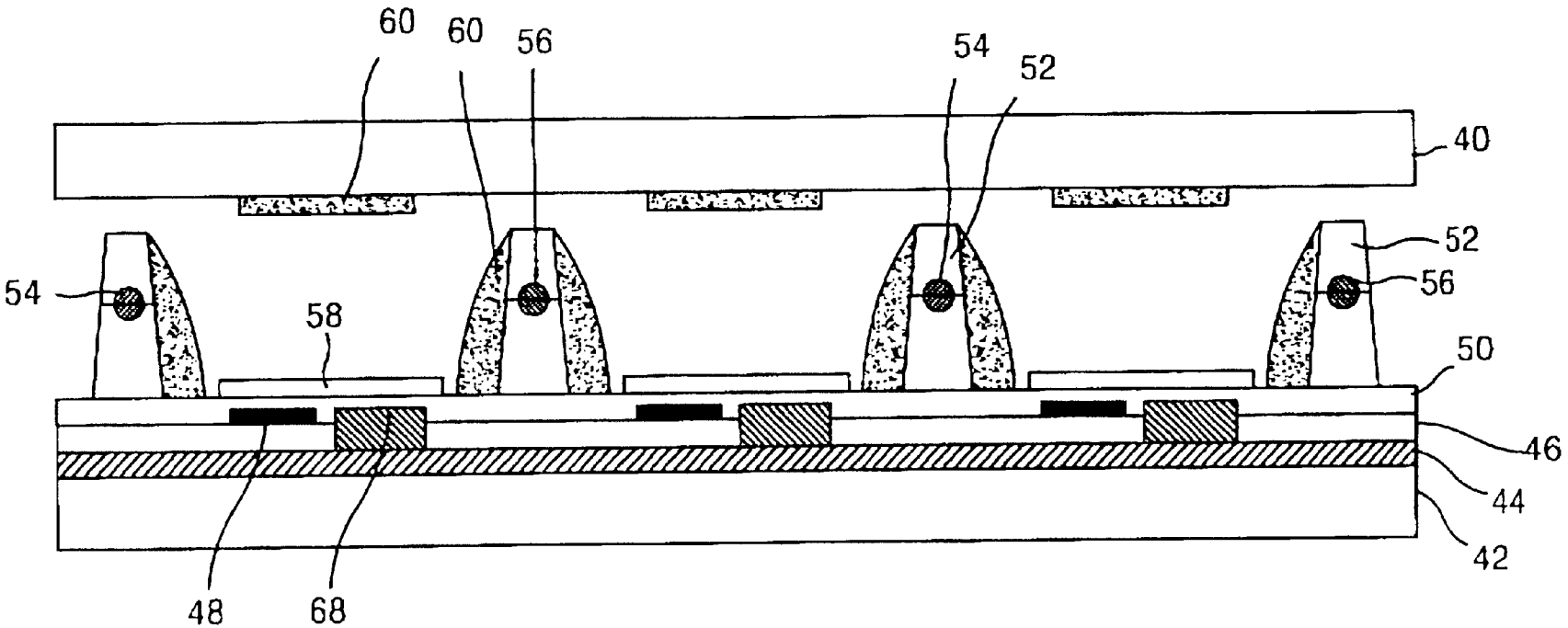
FIG. 7 is a section view of a plasma display panel in which the discharge cells shown in FIG. 6 are arranged in a matrix type.
Figure 8:
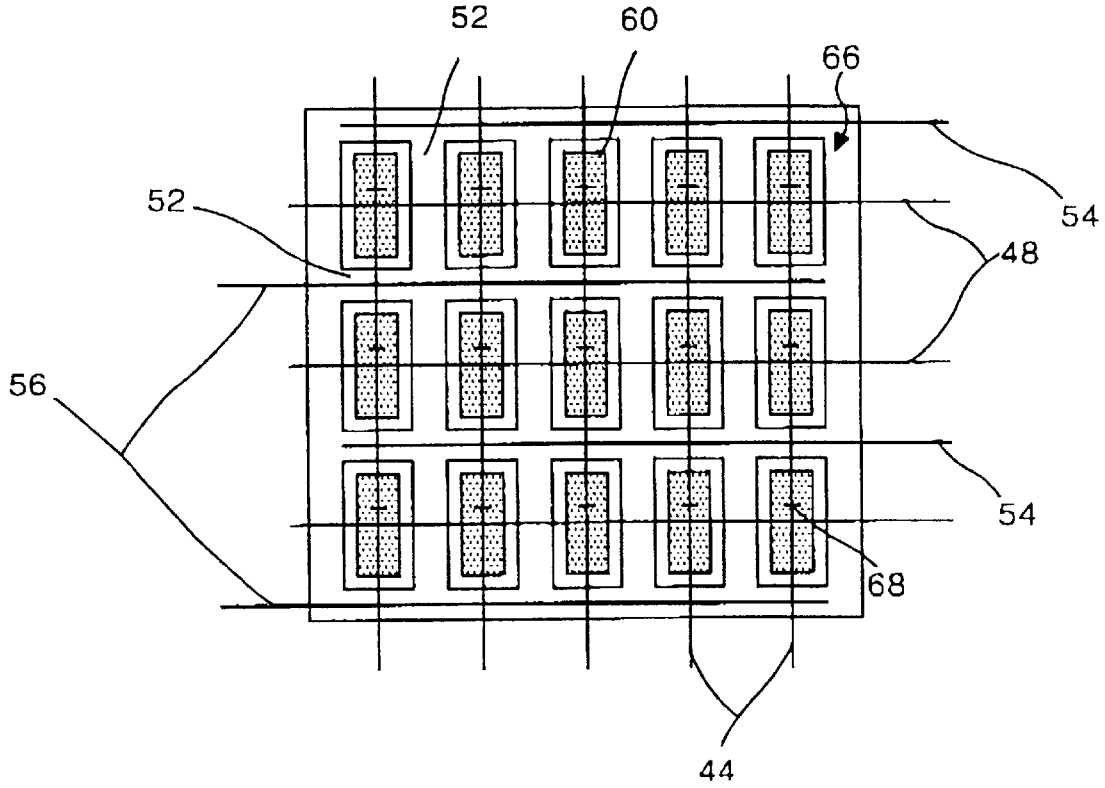
FIG. 8 is a plan view of a plasma display panel in which the discharge cells shown in FIG. 6 are arranged in a matrix type.

FIG. 6 is a section view showing a structure of a discharge cell in a radio frequency PDP according to a second embodiment of the present invention. FIG. 7 and FIG. 8 are a section view and a plan view of a radio frequency PDP in which the discharge cells in FIG. 6 are arranged in a matrix pattern, respectively. A discharge cell 66 shown in FIG. 6 has the same elements and features as that in FIG. 3 except that a data electrode 44 further includes an auxiliary electrode 68 having the same height as the scanning electrode 48. A radio frequency electrode 54 and a radio frequency bias electrode 56 are formed at the interior of barrier ribs 52 parallel to each other in the longitudinal direction Y of the discharge cell 66 to be shared in the adjacent two discharge cells. The auxiliary electrode 68 is close to an intersection between the data electrode 44 and the scanning electrode 48 to be formed in parallel to and at the same height as the scanning electrode 48. Thus, the data electrode 44 including the scanning electrode 48 and the auxiliary electrode 68 applies an address driving voltage, via a second dielectric layer 50 having the same thickness, to a discharge space 62, so that a discharge uniformity can be improved. Furthermore, most address driving voltage applied, via the data electrode 44, to the auxiliary electrode 68 is loaded into the discharge space 62. This is because a thickness of the second dielectric layer 50 on the auxiliary electrode 68 is thinner than that of dielectric layers 20 and 24 on the data electrode 18 shown in FIG. 1 to reduce a voltage drop value caused by the dielectric layers. As a result, the radio frequency PDP according to the second embodiment of the present invention can lower an address driving voltage in comparison to the prior art. In this case, an address discharge field concentrates only on an area between the auxiliary electrode 68 and the scanning electrode 48, so that a crosstalk between the adjacent discharge cells can be prevented. A radio frequency sustaining discharge following such an address discharge is generated between the radio frequency electrode 54 and the radio frequency bias electrode 56 opposed to each other in the longitudinal direction Y of the discharge cell 66 as mentioned above. As described above, the radio frequency PDP according to the second embodiment of the present invention also generates the address discharge and the radio frequency sustaining discharge with a different electrode, so that it can minimize an electrical interference between the two discharges.

Herein, the auxiliary electrode 68 can be made by a method of disposing an electrode material on the data electrode 44 into a height to be provided with the scanning electrode 48 by the screen printing technique. Alternately, the auxiliary electrode 68 may be made by a method of patterning the first dielectric layer 46 formed on the data electrode 44 to define a hole and thereafter filling an electrode material in the hole.

Figure 1:
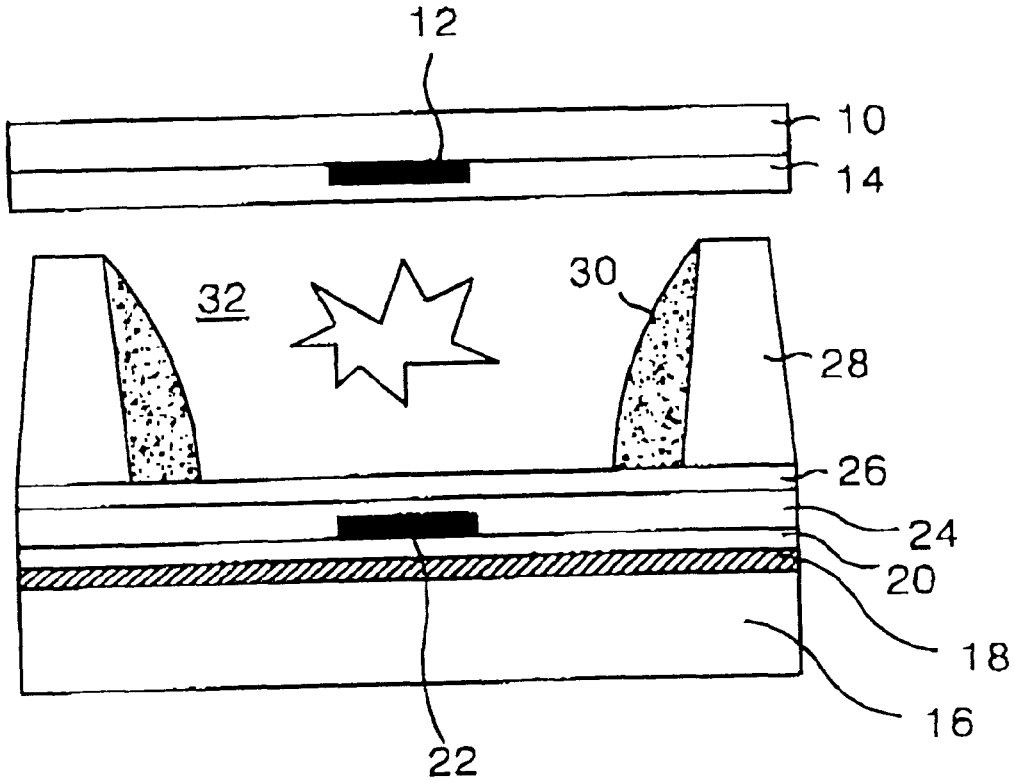
FIG. 1 RELATED ART
FIG. 1 is a section view showing a structure of a discharge cell in a conventional radio frequency plasma display panel.
Figure 9:
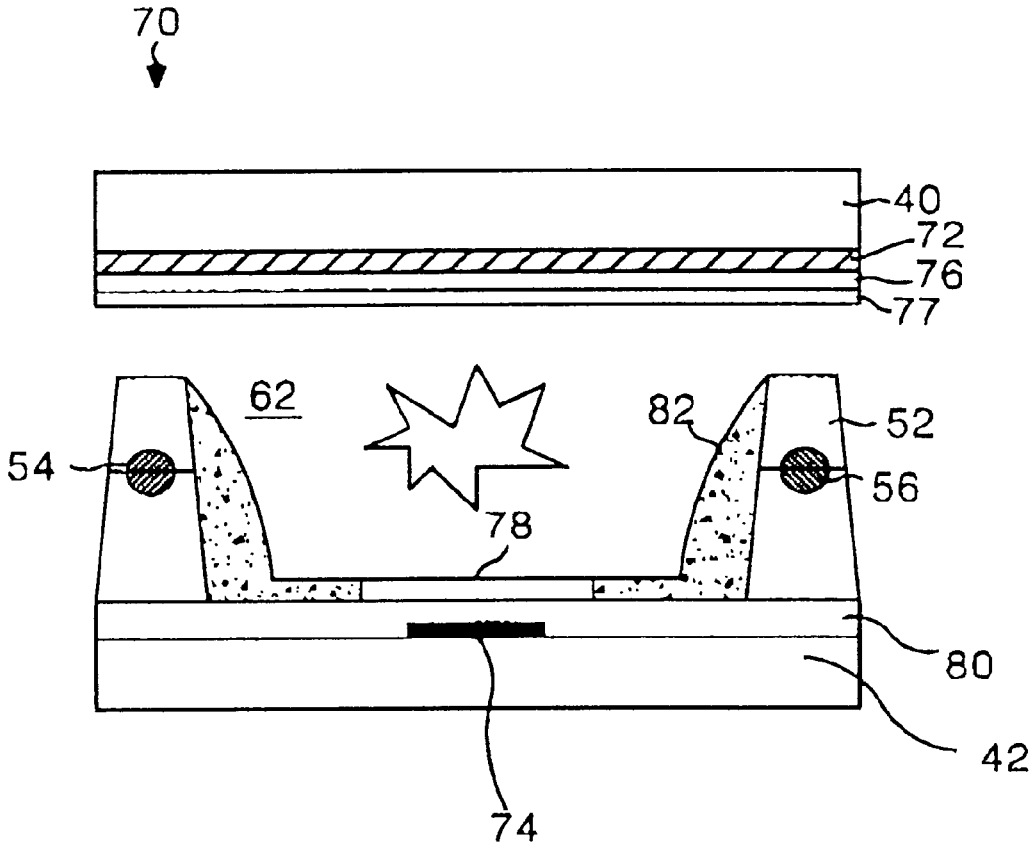
FIG. 9 is a section view showing a structure of a discharge cell in a radio frequency plasma display panel according to a third embodiment of the present invention.
Figure 10:
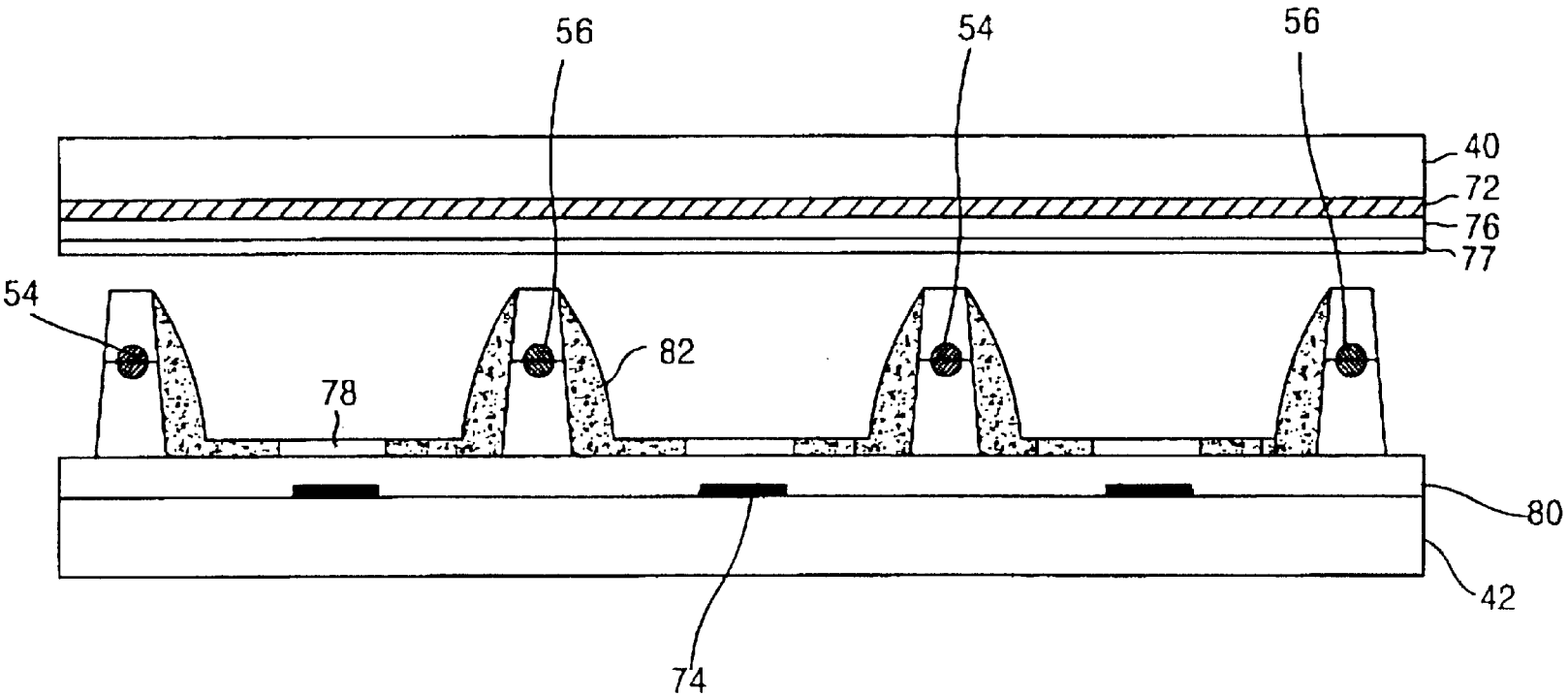
FIG. 10 is a section view of a plasma display panel in which the discharge cells shown in FIG. 9 are arranged in a matrix type.
Figure 11:
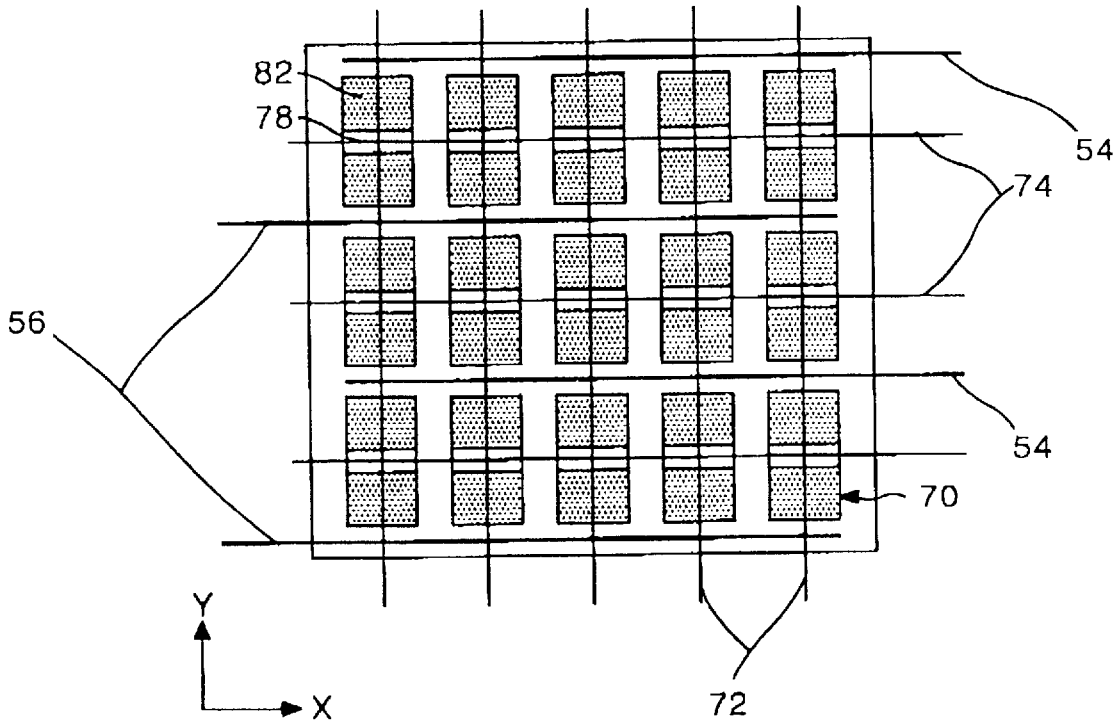
FIG. 11 is a plan view of a plasma display panel in which the discharge cells shown in FIG. 9 are arranged in a matrix type.

FIG. 9 is a section view showing a structure of a discharge cell in a radio frequency PDP according to a third embodiment of the present invention. FIG. 10 and FIG. 11 are a section view and a plan view of a radio frequency PDP in which the discharge cells in FIG. 9 are arranged in a matrix pattern, respectively. A discharge cell 66 shown in FIG. 9 has the same elements and features as that in FIG. 3 except that a data electrode 72, a dielectric layer 76 and a protective film 77 are provided on an upper substrate 40 and that a coated position of a fluorescent material 82 is partially changed. A radio frequency electrode 54 and a radio frequency bias electrode 56 are formed at the interior of barrier ribs 52 parallel to each other in the longitudinal direction Y of the discharge cell 70 to be shared in the adjacent two discharge cells. The data electrode 72 is formed from a transparent electrode material on the upper substrate 40. On the upper substrate 40 provided with the data electrode 72, the first dielectric layer 76 and the first protective film 77 are sequentially disposed. The scanning electrode 74 is formed on a lower substrate 42 in a direction perpendicular to the data electrode 72. On the lower substrate 42 provided with the scanning electrode 74, a second dielectric layer 80 and a second protective film 78 are sequentially disposed. In this case, the first and second protective films 77 and 78 for protecting the dielectric layers 76 and 80 and for enhancing a secondary electron generation ratio overlap with the data electrode 72 and the scanning electrode 74, respectively. The fluorescent material 82 is coated on the inner surface of the barrier ribs 52 exposed to the discharge space 62 and the second dielectric layer 80 in which the first protective film 78 is not formed. In such a discharge cell 70, the first and second dielectric layers 76 and 80 are set to an equal thickness. Thus, the data electrode 72 and the scanning electrode 74 applies an address driving voltage, via the respective first and second dielectric layers 76 and 80 having the same thickness, to the discharge space 62, so that an uniformity of the address discharge can be improved. Furthermore, a single dielectric layer 76 is formed on the data electrode 72. This results in a voltage drop value caused by the dielectric layers being more reduced than the case where two dielectric layers 20 and 24 are formed on the data electrode 18 as shown in FIG. 1. Accordingly, the radio frequency PDP according to the third embodiment of the present invention can lower an address driving voltage in comparison to the prior art. Meanwhile, if a height of the barrier rib 52 is large, then an address driving voltage is increased due to an increase in a distance between the data electrode 72 and the scanning electrode 74. Otherwise, if a height of the barrier rib 52 is small, then a loss ratio of charged particles is increased to reduce a discharge efficiency. Thus, the barrier rib 56 must be formed to have a suitable height. A radio frequency sustaining discharge following such an address discharge is generated between the radio frequency electrode 54 and the radio frequency bias electrode 56 opposed to each other in the longitudinal direction Y of the discharge cell 66 as mentioned above. As described above, the radio frequency PDP according to the third embodiment of the present invention also generates the address discharge and the radio frequency sustaining discharge with a different electrode, so that it can minimize an electrical interference between the two discharges.

As described above, according to the present invention, since the radio frequency electrode and the radio frequency bias electrode for a radio frequency discharge are formed within the barrier ribs parallel to each other in the longitudinal direction of the discharge cell, a frequency of the radio frequency signal is determined depending on a length in the longitudinal direction of the discharge cell. Accordingly, a height of the barrier rib is set to a relatively low value irrespectively of a frequency of the radio frequency signal, so that a transmissivity of a visible light can not only be improved, but also the barrier rib can be easily made by the conventional barrier rib fabricating method. Also, since the fluorescent material are provided on the side surfaces of the barrier ribs as well as the upper substrate or the lower substrate to enlarge a coated area, an emission quantity of a visible light can be increased.

Furthermore, according to the present invention, the data electrode is formed to have the same height as the scanning electrode using the auxiliary electrode, so that it becomes possible to lower an address driving voltage and improve a discharge uniformity. In this case, since any electrode for reflecting a visible light is not formed on the upper substrate, a transmissivity of a visible light can be improved. Otherwise, since a thickness of the dielectric layer can be easily controlled when the scanning electrode and the data electrode is formed on a different substrate, an address discharge efficiency can be improved.

Moreover, the present radio frequency PDP has a four-electrode structure to generate the address discharge and the radio frequency sustaining discharge independently with a different electrode. Accordingly, an electrical interference between a low frequency address driving signal for an address discharge and a radio frequency sustaining signal for a radio frequency discharge is minimized, so that an additional circuit such as the low pass filter in the prior art is not required to more simplify the driving circuit and the driving method.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A radio frequency plasma display panel in which a plurality of discharge cells are arranged in a matrix, each of said discharge cells comprising:

first and second substrates;

first and second address electrodes provided on at least one of the first and second substrates to generate an address discharge;

barrier ribs provided between the first and second substrates to define a discharge space; and first and second radio frequency electrodes provided within the respective barrier ribs opposed to each other in the longitudinal direction of the discharge cell to generate a radio frequency sustaining discharge.

2. The radio frequency plasma display panel as claimed in claim 1, wherein the first and second radio frequency electrodes are shared in adjacent discharge cells having the barrier ribs therebetween.

3. The radio frequency plasma display panel as claimed in claim 1, wherein the first and second radio frequency electrodes are alternately arranged for each of said barrier ribs.

4. The radio frequency plasma display panel as claimed in claim 1, wherein the first and second address electrodes are electrically isolated from the first substrate and arranged perpendicularly to each other.

5. The radio frequency plasma display panel as claimed in claim 1, wherein the second address electrode is positioned at a lower level than the first address electrode, and the second address electrode further includes an auxiliary electrode having a plane at the same height as the first address electrode.

6. The radio frequency plasma display panel as claimed in claim 5, wherein an auxiliary electrode is independently provided for each of the discharge cells and is formed to extend parallel in the longitudinal direction to the second address electrode, and wherein the auxiliary electrode and the first address electrode are of the same height.

7. The radio frequency plasma display panel as claimed in claim 5, further comprising:

a fluorescent material coated on side surfaces of the barrier ribs and a surface of the second substrate;

a first dielectric layer provided between the first and second address electrodes;

a second dielectric layer formed on the first dielectric layer provided with the second address electrode; and a protective film formed partially on the second dielectric layer.

8. The radio frequency plasma display panel as claimed in claim 1, wherein each of the barrier ribs has a structure in which all sides thereof are closed.

9. The radio frequency plasma display panel as claimed in claim 1, wherein the first and second address electrodes are arranged perpendicularly to each other on the first and second substrates, respectively.

10. The radio frequency plasma display panel as claimed in claim 1, further comprising:

a first dielectric layer formed on the first substrate provided with the first address electrode;

a second dielectric layer formed on the second substrate provided with the second address electrode;

first and second protective films formed on the first and second dielectric layer in such a manner to overlap with the first and second address electrodes, respectively; and a fluorescent material coated on at least one of the first and second substrates and the side surfaces of the barrier ribs.

11. The radio frequency plasma display panel as claimed in claim 1, wherein the first and second address electrodes apply a low frequency of commercial alternating current pulse and are driven independently of the first and second radio frequency electrodes.

12. A radio frequency plasma display panel in which a plurality of discharge cells are arranged in a matrix, each of said discharge cells comprising:

first and second substrates;

first and second address electrodes provided on at least one of the first and second substrates to generate an address discharge, the second address electrode further including an auxiliary electrode;

barrier ribs provided between the first and second substrates to define a discharge space; and a plurality of radio frequency electrodes provided within the respective barrier ribs.

13. The radio frequency plasma display panel as claimed in claim 12, wherein the plurality of radio frequency electrodes comprise first and second radio frequency electrodes opposed to each and configured to generate a radio frequency sustaining discharge.

* * * * *